United States Patent [19]

Wolfe

[11] 4,080,153

[45] Mar. 21, 1978

[54] THERMAL SWITCH

[75] Inventor: Denis G. Wolfe, Santa Ana, Calif.

[73] Assignee: Robertshaw Controls Company, Richmond, Va.

[21] Appl. No.: 710,433

[22] Filed: Aug. 2, 1976

[51] Int. Cl.[2] ..... F23Q 9/12

[52] U.S. Cl. ..... 431/42; 337/387; 431/78

[58] Field of Search ..... 337/123, 383, 387; 431/42, 78, 43, 44

[56] References Cited

U.S. PATENT DOCUMENTS

| | | | |
|---|---|---|---|
| 2,089,081 | 8/1937 | Wemple | 337/387 |
| 3,498,730 | 3/1970 | Wolfe | 431/42 |

*Primary Examiner*—Edward G. Favors

*Attorney, Agent, or Firm*—Fulwider, Patton, Rieber, Lee & Utecht

[57] ABSTRACT

There is disclosed a thermally responsive switch that is ideally suited for responding to the ignition and extinguishment of a flame. The switch is provided with two switch poles, one that is biased normally open and the other that is biased normally closed. The response of the switch to the presence of a flame is very sensitive and precise to open the normally closed contact within a few seconds after ignition of a flame and, shortly thereafter within another controlled time period, to close the normally open contact. Upon extinguishment of the flame, the switch reverses its movement, opening the normally open contact within a short time interval, and, thereafter, closing the normally closed contact. The switch mechanism employs a thermally responsive, tube-in-tube member with the inner tube connected to a push rod which resiliently carries a switch lever. The switch lever has lateral tabs which are captured within first and second slots of brackets which are on the switch blade and which have predetermined widths to provide lost motion connections between the switch lever and the switch blade. The switch blade is biased resiliently towards the normally closed contact and this bias is laterally unbalanced to provide a stepping action of the switch lever. The switch lever also resiliently receives and is carried on the push rod whereby it accomodates thermal deformation of the tube assembly which is in excess of that necessary for the opening and closing functions of the switch.

16 Claims, 11 Drawing Figures

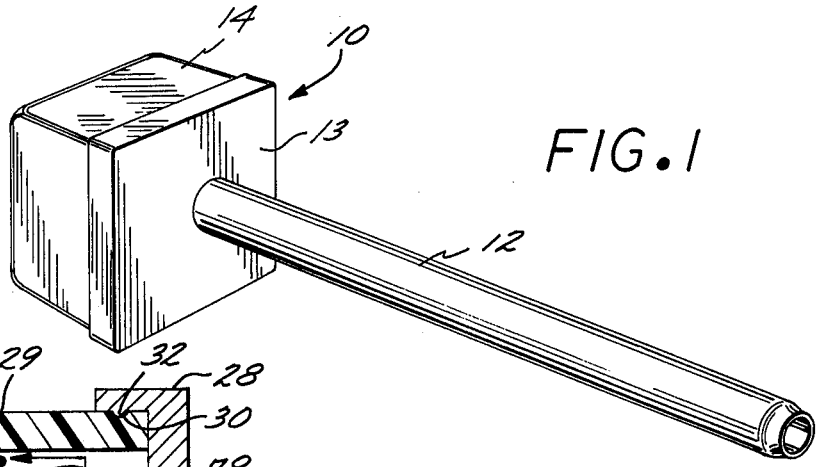
FIG. 1
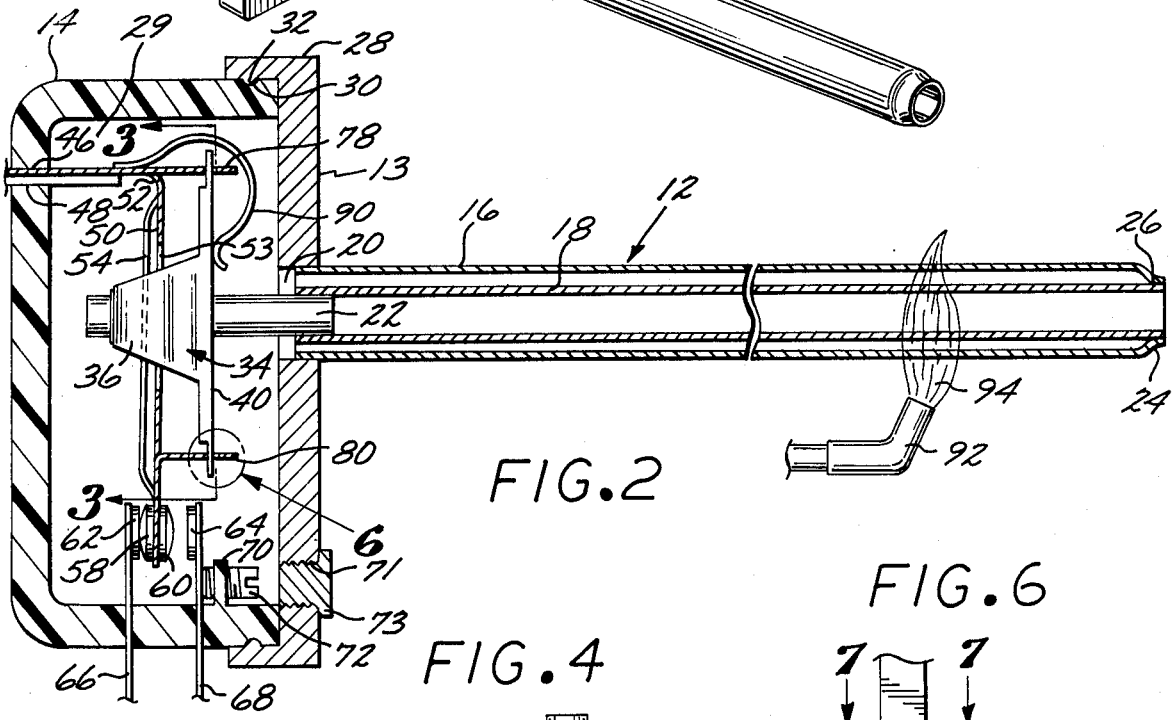
FIG. 2
FIG. 6
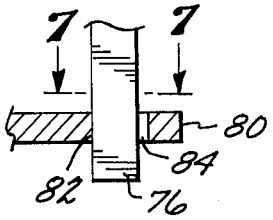
FIG. 4
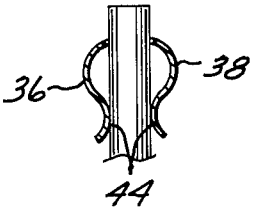
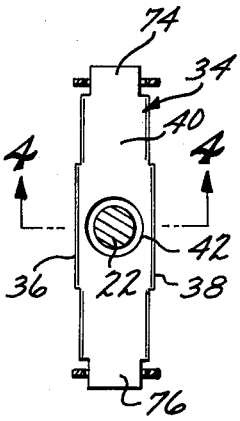
FIG. 3
FIG. 5
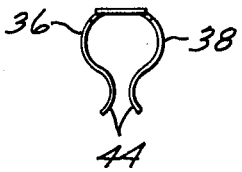
FIG. 7
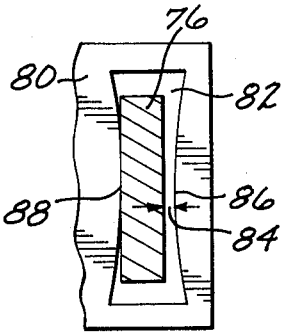

THERMAL SWITCH

BACKGROUND OF THE INVENTION

1. Field of the Invention

This invention relates to a switch mechanism and, in particular, to a thermally responsive switch useful as a flame switch and the like in a burner system.

2. Brief Statement of the Prior Art

Various devices have been designed for flame detection at a pilot burner in the burner assembly of heating appliances such as furances, water heaters and the like. Some of these devices have employed a thermally responsive unit having an outer metal tube and an inner metallic or ceramic rod. One end of this unit is secured to a switch housing with its opposite end interconnected so, when heated, a differential thermal expansion occurs between the outer tube and the inner rod. The inner rod is connected through various mechanisms to the switch blade of a switch mechanism. Typically, the device includes a spring to bias the switch in a normally off position in the event of failure of the thermally responsive unit. Typical of this device is that which is described in U.S. Pat. Nos. 3,194,927 and 3,310,047.

Another, similar type is described in U.S. Pat. No. 3,235,691. Each of the foregoing devices have a clutch mechanism between the thermally responsive unit and the switch mechanism, thereby accomodating for thermal expansion in excess of that necessary to operate the switch contacts.

The aforedescribed switch mechanisms must be individually calibrated and use elements which are not readily adaptable to mass manufacture with simple machine operations such as stamping, punching and the like. The devices also have a high maintenance requirement since their thermal response changes during use by fatigue of metal parts, formation of metal oxide surfaces, etc.

BRIEF DESCRIPTION OF THE INVENTION

This invention comprises a thermally responsive switch which is very sensitive to the ignition and extinguishment of a flame and responds in a controllable, precise manner to open a normally closed switch contact and to close a normally open switch contact, sequentially, within predetermined time intervals after ignition of a flame and to respond similarly in a reverse manner by sequentially opening the normally open contact and closing the normally closed contact within predetermined time intervals following extinguishment of the flame.

The switch mechanism employs a tube-in-tube thermally responsive element having a differential thermal expansion. The outer tube is supported by the switch housing and the inner tube bears a push rod which resiliently carries a switch layer. The switch lever has opposite center prongs which are folded to form leaf springs that resiliently engage the push rod and provide a slip clutch mechanism. The switch lever bears opposite, lateral tabs which are captured within slots of brackets carried on the switch blade. The slots are of predetermined thickness, slightly greater than the thickness of the metal tabs received therein, to provide a lost motion link between the switch lever and the switch blade. The switch blade is pivotally secured in the housing and moves between opposing contact poles of the switch that are disposed at one side of the housing. Resilient means, in the form of a leaf spring, biases the switch lever and blade towards the normally closed contact. This resilient means is asymmetrically applied to the lever arm whereby the lever arm responds, in a stepping action, to dimensional changes of the thermally responsive unit.

BRIEF DESCRIPTION OF THE FIGURES

The invention will be described by reference to the illustrations of which:

FIG. 1 is a perspective view of the assembled unit;

FIG. 2 is a cross sectional unit of the switch mechanism;

FIG. 3 is a view along lines 3—3 of FIG. 2;

FIG. 4 is a view along lines 4—4 of FIG. 3;

FIG. 5 is a side view of the switch lever removed from the push rod;

FIG. 6 is a view of the encircled area at 6 on FIG. 2;

FIG. 7 is a view along line 7—7 of FIG. 6; and

DESCRIPTION OF THE PREFERRED EMBODIMENTS

Figure 8:
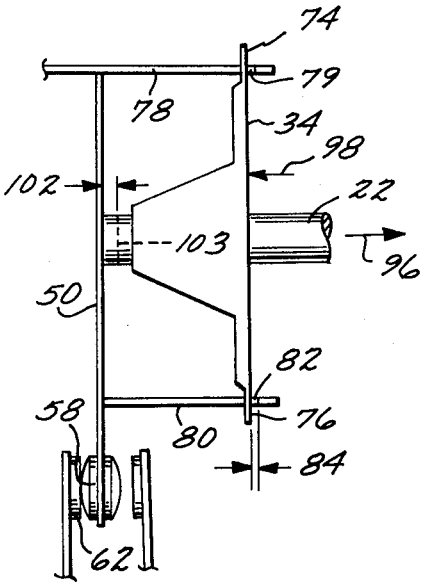
FIGS. 8–11 illustrate the operation of the switch mechanism.

Referring now to FIG. 1, the switch mechanism 10 includes a thermally responsive unit 12 which projects from the base plate 13 of a housing assembly which includes a cup-shaped member 14, defining an interior chamber in which are housed the elements of the switch mechanism. These elements are shown in greater detail in FIG. 2.

As shown in FIG. 2, the thermally responsive element 12 includes an outer metallic tubular member 16 and a generally concentric, inner tubular member 18 which is also metallic. The materials employed for these tubes as well as their wall thicknesses are preselected to obtain a thermally responsive unit having a relatively high differential thermal expansion. Suitably, the outside tube is of a metal having a high thermal coefficient of expansion such as Incoloy alloys and the like while the inside tube is of a metal having a relatively low thermal coefficient of expansion such as stainless steel and the like.

The outer tube is carried on plate 13 of the housing having a central aperture 20 to receive this tube. The tube can be secured to plate 12 by welding and the like. The end of tube 18 receives push rod 22 which is secured thereto by bonding with a suitable adhesive. The tubes 16 and 18 of the assembly are interconnected at their opposite ends. This can be accomplished by rolling the end of outer tube 16 inwardly to form an annular flange 24 that is welded at 26 to the end of the inner tube. The switch mechanism 10 in use is mounted near a pilot burner 92 with the tube assembly 12 contacted by the flame 94 of the pilot burner.

The housing of the switch mechanism is defined by plate 13 which has a peripheral rim 28 to receive the cup-shaped member 14, thereby defining a sealed interior chamber 29. Preferably, the assembly of the plate and cup-shaped member is secured by a groove 30 about the outer, received edges of the cup shaped member 14 which receives the raised bead 32 about the inner wall of rim 26.

The push rod 22 slidably receives switch lever 34 to provide a slip clutch connection. The details of this construction are shown in FIGS. 3–5 and are described briefly as follows. The switch lever can be formed by a metal stamping operation that forms central prongs 36 and 38 which are bent out of the plane of the arm 40 of the switch lever and which are provided with the reverse arcuate bends, shown in FIGS. 4 and 5. The arm 40 of the switch lever has a central aperture 42 which receives push rod 22. The free end of push rod 22 extends past the bights 44 of the bent prongs 36 and 38 and these bights resiliently bear against the push rod to provide a frictional engagement of the push rod with a predetermined frictional drag which can be controlled by the resiliency of the bent prongs and the polish of the surface of the push rod.

The switch mechanism of the device is carried within the housing by a support arm 46 which is received within an aperture 48 of the member 14 and is secured thereto by bonding with a suitable adhesive or potting compound. The switch blade 50 is pivotally secured to support arm 46. In the illustrated embodiment, these elements are a common metallic member with the switch blade 50 having a right angle bend 52. The switch blade 50 bears a central, large diameter aperture 54 to receive the end of push rod 22 and the prongs 36 and 38 of the lever 34. Preferably, the switch blade 50 is reinforced by one or more longitudinal ribs 53.

The free end of the switch blade distally bears, on opposite sides, switch contacts 58 and 60. These switch contacts are supported between opposed contacts 62 and 64 which are carried by support arms 66 and 68 that project through apertures in a sidewall of the housing. The contact 62 is rigidly secured within the housing while contact 64 can be fixedly adjusted. To this end, the interior wall of member 14 bears a flange 70 which has a threaded aperture for receiving set screw 72 that projects against arm 68 and thereby provides means for the fixed adjustability of the position of the contact 64. Plate 13 can have an aperture 71 which is closed with plug 73 that is removable to provide access to screw 72.

The switch lever is connected to the switch blade 50 by a lost motion, spring biased mechanism which imparts a stepping action to the switch mechanism. The switch arm 40 bears lateral tabs 74 and 76 which are captured within slots of brackets 78 and 80, respectively. Bracket 78 depends from support arm 46 and, if desired, can be an integral extension of this member. The bracket 80 depends from the free end of switch blade 50 and, also if desired, can be an integral portion of the switch blade 50 which is bent at a right angle thereto.

Referring now to FIGS. 6 and 7, the connection between the lateral tabs of the switch lever and the bracket members can be seen in greater detail. As there illustrated, the lateral tab 76 projects into a slot 82 distally positioned in bracket 80. The slot 82 is of a predetermined greater width than the thickness of tab 76 to provide a clearance space 84 (see FIG. 7) therebetween. Preferably space 84 is from 0.001 to about 0.01 and, most preferably, from 0.003 to 0.004, inch. This tolerance, with the preferred thermally responsive unit, provides a time interval from ignition to opening of the normally closed, fixed position contact 62 from one to about five, preferably about three seconds.

As shown in FIG. 7, slot 82 is provided with opposite arcuate sides 86 and 88 whereby any twisting or rocking of arm 34 on push rod 22 will not cause any significant change in the dimension of space 84.

The switch mechanism is also provided with resilient means for applying a laterally unbalanced force to the switch arm 34. The resilient means is illustrated in FIG. 2 as the leaf spring 90 which is dependent from support arm 46 and which has an arcuate bend in the form of a shephard's hook. If desired, this spring 90 can be integral with the support arm 46 and/or bracket 78, or can be as illustrated as a separate member that is secured to the support arm 46 by suitable means such as bonding, welding, riveting and the like. The spring 90 asymmetrically biases lever 34 by bearing against a laterally offset portion of arm 40 to insure a stepwise action of the switch mechanism which will be described in the following paragraphs with reference to FIGS. 8–11.

The switch elements are illustrated schematically in FIGS. 8–11. The relative positions of the push rod and the switch mechanism is altered from that illustrated in FIG. 2 to demonstrate the amount of axial displacement which can be compensated by the switch mechanism. As there illustrated, push rod 22 carries arm 34. The switch contact 58 bears against the fixed position switch contact 62. The switch mechanism is illustrated in its normally closed, cold position typical of the absence of the flame at pilot burner 92. Upon ignition of the pilot burner, flame 94 heats the thermally responsive tube-in-tube assembly 12, causing longitudinal expansion of the outer tube 16 at a greater rate than the shielded inner tube 18 which also has a lower thermal coefficient of expansion. The resultant thermal expansion moves push rod 22 in the direction of arrowhead line 96. The resultant movement of arm 34 is resiliently restrained by spring 90 that asymmetrically applies a spring force illustrated by arrowhead line 98 to one side of arm 34. The movement of the push rod 22 thus causes a pivotal movement of arm 34 about the point of contact between spring 90 and arm 34 (arrowhead line 98). This pivotal movement must be sufficient to cause the tab 76 to move the distance 84 within slot 82 before any movement of bracket 80 will occur, thereby providing a lost motion link between the switch arm 34 and the switch blade 50. As previously mentioned, this dimension 84 is predetermined in relation to thermal expansion characteristics of tube-in-tube assembly 12 to provide a time interval of from one to about 10, preferably about 3, seconds after ignition of flame 94.

Figure 9:
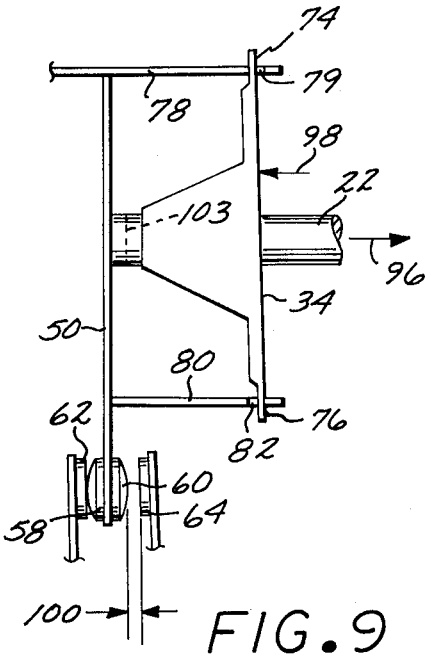

FIG. 9 illustrates the switch mechanism after rod 22 has been moved in the direction of line 96 a sufficient amount to traverse the tolerance 84 in slot 82 and at this position, any further movement will separate contacts 58 and 62. After separation of these contacts, the continued movement of rod 22 will move the switch blade 50 and cause contact 60 to traverse the space 100 and close the normally open switch contact 64. The dimension 100 is fixedly adjustable by the adjustment set screw 72, previously described. In a typical embodiment, this dimension is set such that the normally open contact 64 is closed within a period of time from 3 to about 15, preferably about 6, seconds. During this movement, the resilient force shown by the arrowhead line 98 restrains lateral tab 74 from travel in the slot 79 of bracket 78.

Figure 10:
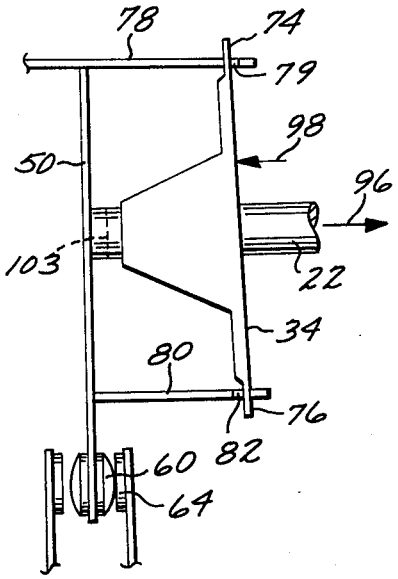

Referring now to FIG. 10, the switch blade 50 has pivoted to swing contact 60 against the fixed position contact 64, closing this normally open contact. The spring force 98 is sufficient to restrain the tab 74 in slot 79, however, any further movement of rod 22 in the direction of line 96 will overcome the resilient force of spring 90 and cause tab 74 to traverse the tolerance in the slot and bear against the opposite wall of slot 79.

Figure 11:
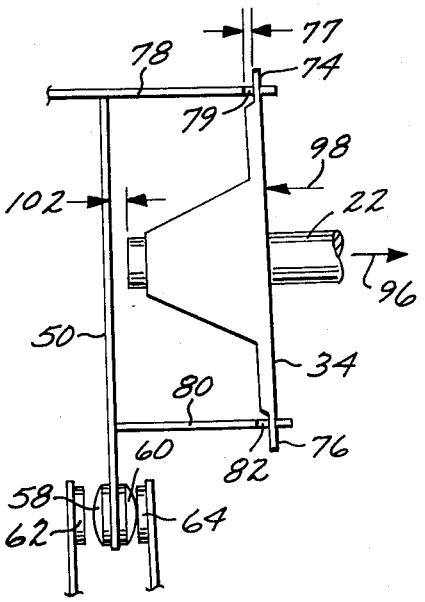

As shown in FIG. 11, the tab 74 has traversed the tolerance 77 within slot 79. At this point, any continued movement of rod 22 in the direction of line 96 will cause rod 22 to slip within the slip clutch assembly of the opposite bent prongs 36 and 38. In the illustrated embodiment, the rod has moved a distance 102 within this slip clutch assembly.

Upon the extinguishment of the flame, the thermal unit beings to cool and the reverse operation of the switch mechanism occurs. Initially, the cooling of the thermal unit 12 moves the rod 22 in a direction opposite of line 96 and tab 74 travels the dimension of tolerance 77, shown in FIG. 11. This travel occurs before separation of contacts 60 and 64 and the normally open contact pole 64 thus remains closed. The resultant position of the switch elements is shown in FIG. 10 with the end of rod 22 located at the position 103. Tolerance 77 is sized sufficiently to require approximately 1 to 5, preferably about 2, seconds after extinguishment of the flame to reach the configuration shown in FIG. 10.

Further cooling of thermal unit 12 causes the assembly of arm 34 and switch blade 50 to move, under the influence of spring 90 to separate the contacts 60 and 64 and traverse the dimension 100 shown in FIG. 9. In this position, the normally closed contact 62 is in proximity to the contact 58 and any further cooling will close these contacts. The dimension 100 is selected to provide a period of cooling of from 5 to about 15, preferably about 10, seconds after extinguishment of the flame.

Continued cooling of the thermal unit 12 causes lateral tab 76 to traverse the tolerance 84, restoring the configuration of FIG. 8. Thereafter, any further cooling will cause the rod 22 to move from its position 103 shown by the broken line of FIG. 8 to the solid line configuration shown in this FIGURE, traversing the dimension 102. At this point, the switch mechanism is restored for cyclic operation.

The switch mechanism thus described is a very sensitive and precisely controllable operation. The assembly can be formed entirely of parts that are simple to manufacture and assemble. The switch elements such as switch arm 34 and the switch blade 50 can be stamped from sheet metal. Similarly, brackets 78 and 80 can be formed by stamping and the slots 79 and 82 can be stamped therein with very precisely controlled dimensions to control the time delays of the switching operations. The entire unit can be assembled with the switch mechanism mounted within the cup-shaped housing member 14 and secured therein and this member can thereafter be closed by the housing plate 13 with its dependent thermal unit 12. During this assembly, the rod 22 is received within the inner tube 18 in a frictional engagement therwith which is secured by application of a suitable adhesive to these elements prior to assembly.

The invention has been described with reference to the presently illustrated and preferred embodiment thereof. It is not intended that the invention be unduly limited by this disclosure. Instead the invention is intended to be defined by the means and their obvious equivalents set forth in the following claims.

What is claimed is:

1. A thermally responsive switch including:

a housing having an internal chamber;

switch support means carried by said housing and projecting into said chamber;

a switch blade dependent from said support means for arcuate movement within said chamber;

a switch contact carried on the free end of said switch blade;

a first bracket carried by said support and a second bracket carried by the free end of said switch blade, each of said brackets bearing respective first and second slots;

at least one, fixed position contact fixedly carried by said housing for contact with said switch blade contact;

temperature responsive means dependent from said housing and supporting a push rod extending into the chamber of said housing;

lever means carried on said push rod by resilient means frictionally engaging said push rod and bearing first and second lateral tabs received in said first and second slots of said first and second brackets with said tabs being of lesser thickness than the width of said slots, thereby providing lost motion coupling between said lever menas and said brackets; and resilient means within said housing and biasing against a laterally offset position of said lever means whereby said lever means responds to axial movement of said push rod in a stepping manner.

2. The thermally responsive switch of claim 1 wherein said temperature responsive means comprises first and second tubular members, one each secured to said housing and push rod, respectively, and distally interconnected at their free ends.

3. The thermally responsive switch of claim 2 wherein said tubular members are of different metals having different thermal coefficients of expansion.

4. The thermally responsive switch of claim 3 wherein said outer tubular member is secured to said housing and said inner tubular member is secured to said push rod.

5. The thermally responsive switch of claim 4 wherein said outer tubular member has a higher coefficient of thermal expansion than said inner tubular member.

6. The thermally responsive switch of claim 1 wherein said housing includes a support base having a peripheral rim receiving a cup-shaped member to define said interior chamber.

7. The thermally responsive switch of claim 1 wherein said lever means comprises a plate having a center aperture to receive said push rod and said resilient means comprised axially folded prongs dependent from said plate and resiliently biased against said rod to engage said rod in frictional engagement.

8. The thermally responsive switch of claim 7 wherein said prongs have a reverse arcuate bend.

9. The thermally responsive switch of claim 1 wherein said housing includes two, fixed position switch contacts positioned therein for engagement by the switch contact of said switch blade at opposite ends of the travel of said switch blade in said housing.

10. The thermally responsive switch of claim 9 including adjustment means for the fixed adjustability of the spacing between said first and second fixed position contacts.

11. The thermally responsive switch of claim 9 wherein the sidewalls of said first and second slots of said first and second brackets are convex.

12. In a control system for a combustion burner system having a main burner for combustion of fuel supplied thereto through first and second control valves and a pilot burner for ignition of combustible fuel discharged from said main burner, including pilot burner fuel supply means extending thereto from between said first and second control valves, ignition means for ignition of combustible fuel discharged from said pilot burner, and heating demand switch means in circuit to said first valve, the improvement in the control system to said second valve which comprises:

a thermally responsive switch, a temperature responsive element supported therefrom to be positioned adjacent to said pilot burner, mechanical linkage extending to the switch blade of a switch having a first, normally closed contact and a second, normally open contact positioned within a switch housing chamber for contact by said switch blade, and lost motion link means having a lever movable within restraints of controlled fixed dimensions for selective positioning against alternative fulcrums, which means interconnects said thermally responsive unit and said switch blade and responds to ignition of the fuel discharged from said pilot burner to open said normally closed contact after a first predetermined time interval controlled by the thermal response characteristics of said thermally responsive switch and by the fixed dimensions of said lost motion link means and to close said normally open contact after a second predetermined time interval.

13. The system of claim 12 wherein said thermally responsive switch has lost motion mechanical link means between said thermally responsive element and said switch blade to open said normally open contact after a third predetermined time interval and to close said normally closed contact after a fourth predetermined time interval, said third and fourth time intervals following the extinguishment of flame at said pilot burner.

14. The thermally responsive switch of claim 12 wherein said mechanical link means between said thermally responsive element and said switch blade includes a frictionally engaging clutch element to permit continued thermal expansion of said thermally responsive unit in excess of that necessary to close said normally open contact.

15. The system of claim 14 wherein the thermally responsive switch includes clutch means in said mechanical linkage to permit contraction of said thermally responsive element in excess of that necessary to close said normally closed contact.

16. The system of claim 12 wherein said mechanical linkage includes resilient means biasing said switch blade in the normally off position.

* * * * *